US010921837B2

(12) United States Patent
Ham

(10) Patent No.: US 10,921,837 B2
(45) Date of Patent: Feb. 16, 2021

(54) VOLTAGE REGULATOR AND OPERATING METHOD THEREOF

(71) Applicant: SK hynix Inc., Gyeonggi-do (KR)

(72) Inventor: Hyun-Ju Ham, Gyeonggi-do (KR)

(73) Assignee: SK hynix Inc., Gyeonggi-do (KR)

( * ) Notice: Subject to any disclaimer, the term of this patent is extended or adjusted under 35 U.S.C. 154(b) by 475 days.

(21) Appl. No.: 15/061,776

(22) Filed: Mar. 4, 2016

(65) Prior Publication Data

US 2017/0110964 A1 Apr. 20, 2017

(30) Foreign Application Priority Data

Oct. 15, 2015 (KR) ..... 10-2015-0143914

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC ..... G05F 1/575; G05F 1/56; G05F 1/565; H03K 19/018521; H03K 17/04123; H02M 3/158; H02M 3/1588
See application file for complete search history.

(56) References Cited

U.S. PATENT DOCUMENTS 7,839,097 B2 * 11/2010 Chen ..... G05F 3/16 323/274
2005/0248391 A1 * 11/2005 Itoh ..... G05F 1/575 327/540
2006/0022652 A1 * 2/2006 Nishimura ..... G05F 1/575 323/280
2006/0261877 A1 * 11/2006 Welty ..... G05F 3/205 327/427
2008/0157740 A1 * 7/2008 Gurcan ..... G05F 1/565 323/283
2008/0174289 A1 * 7/2008 Gurcan ..... G05F 1/575 323/280
2008/0265856 A1 * 10/2008 Takada ..... G05F 1/565 323/280
2011/0156674 A1 * 6/2011 Lin ..... G05F 1/575 323/282
2014/0002042 A1 1/2014 Wismar et al.
2014/0320327 A1 * 10/2014 Fan ..... H02M 7/02 341/144
2015/0097534 A1 * 4/2015 Bhattad ..... G05F 1/575 323/270

FOREIGN PATENT DOCUMENTS

CN 101174790 5/2008
CN 102262411 11/2011
KR 1020150050880 5/2015

OTHER PUBLICATIONS

Office Action issued by the State Intellectual Property Office dated May 3, 2018.

* cited by examiner

*Primary Examiner* — Jue Zhang
(74) *Attorney, Agent, or Firm* — IP & T Group LLP

(57) ABSTRACT

A voltage regulator includes a voltage regulation unit that regulates an external power supply voltage and outputs an internal voltage, and an optimization control unit that adjusts a bias current, drivability, and output capacitance of the voltage regulation unit in response to a training enable signal and optimizes the internal voltage to a predetermined value.

22 Claims, 7 Drawing Sheets

VOLTAGE REGULATOR AND OPERATING METHOD THEREOF

CROSS-REFERENCE TO RELATED APPLICATIONS

The present application claims priority of Korean Patent Application No. 10-2015-0143914, filed on Oct. 15, 2015, which is incorporated herein by reference in its entirety.

BACKGROUND

1. Field

Exemplary embodiments of the present invention relate generally to semiconductor design technology and more particularly, to a voltage regulator for a semiconductor device and an operating method thereof.

2. Description of the Related Art

An integrated circuit such as a semiconductor memory device may be a functionally complex electronic device or system having a microstructure in which many electronic circuit elements are inseparably defined on a semiconductor substrate. Because the electronic circuit elements in such an integrated circuit may have a micro size, even very small fluctuations in a current or voltage supplied to the integrated circuit may cause the integrated circuit to malfunction.

For maintaining a voltage supplied to the integrated circuit constant, a regulator circuit for constantly controlling the output of a voltage supply circuit is required.

Generally, proper operation of a semiconductor memory device may require simultaneous generation of a plurality of operation voltages when programming data, including, for example, program and pass voltages. In this regard, one or more regulator circuits may be required for regulating the respective operation voltages.

SUMMARY

Various embodiments of the present invention are directed to a voltage regulator capable of optimizing an output voltage and an operating method thereof.

In an embodiment, a voltage regulator may include: a voltage regulation unit suitable for regulating an external power supply voltage and for outputting a constant internal voltage; and an optimization control unit suitable for adjusting a bias current, a drivability, and an output capacitance of the voltage regulation unit in response to a training enable signal and for optimizing the internal voltage to a predetermined value.

The voltage regulation unit may include: a comparator suitable for comparing a reference voltage with a feedback voltage for outputting a driving signal and for operating using the bias current; a bias current adjustment section suitable for adjusting the bias current supplied to the comparator in response to a first control signal; a pass device adjustment section suitable for outputting the external power supply voltage to an output terminal as the Internal voltage according to the driving signal, and for adjusting the drivability in response to a second control signal; a capacitor adjustment section suitable for adjusting the output capacitance in response to a third control signal; and a voltage division section suitable for dividing the output voltage and for outputting a divided voltage to an Input terminal of the comparator as the feedback voltage.

The optimization control unit may include: an average detecting section suitable for detecting an average value of the internal voltage corresponding to a first or a second mode in response to the training enable signal; and a control signal generation section suitable for comparing the average value of the internal voltage with a target value for generating the first to third control signals.

The average detecting section may include: an undershoot detecting part suitable for detecting an undershoot peak voltage of the internal voltage; a mode selection part suitable for selectively outputting an output signal of the undershoot detecting part or the Internal voltage in response to a mode selection signal; an analog-to-digital converter suitable for converting an output signal of the mode selection part into digital code values; and an average calculating part suitable for outputting an average value of the digital code values outputted from the analog-to-digital converter.

The mode selection part may select the internal voltage in the first mode and may select the output signal of the undershoot detecting part in the second mode.

The control signal generation section may include: a register suitable for storing the target value; and an operation control part suitable for comparing the target value with the average value and for controlling each of the first to third control signals.

Each of the first to third control signals may be provided in a plural number.

The pass device adjustment section may include: a pass device selection part suitable for selecting one or more of a plurality of pass devices in response to the plurality of second control signals; and a pass device array part including the plurality of pass devices and suitable for driving the external power supply voltage in response to the driving signal.

The pass device selection part may include a plurality of transfer elements suitable for transferring the driving signal to the pass device array part in response to the second control signals.

The capacitor adjustment section may include: a capacitor transfer control part suitable for selecting one or more of a plurality of capacitors in response to the plurality of third control signals; and a capacitor array part including the plurality of capacitors and suitable for substantially maintaining the internal voltage to be constant.

The capacitor transfer control part may include a plurality of transfer elements suitable for transferring the internal voltage to the capacitor array part.

The voltage regulator may further include a frequency compensation section suitable for ensuring a phase margin of the Internal voltage.

The average detecting section may include: an undershoot detecting part suitable for detecting an undershoot peak voltage of the internal voltage; a mode selection part suitable for selectively outputting an output signal of the undershoot detecting part or the internal voltage in response to a mode selection signal; a gain integrator suitable for integrating and outputting an output signal of the mode selection part; and an analog-to-digital converter suitable for converting an output signal of the gain integrator into a digital code value.

The mode selection part may select the internal voltage in the first mode and may select the output signal of the undershoot detecting part in the second mode.

In another embodiment, an operating method of a voltage regulator may include: detecting an undershoot of an output voltage of the voltage regulator; selecting the output voltage of the voltage regulator in a first mode and selecting the undershoot in a second mode in response to a mode selection signal; converting the output voltage or the undershoot into digital codes; calculating an average value of the digital codes; comparing the average value with a target value stored in a register and generating a control signal for controlling the voltage regulator; and performing a voltage regulating operation in response to the control signal.

The generating of the control signal may include: comparing the target value with the average value and generating a first control signal for adjusting a current amount of a bias current of the voltage regulator; comparing the target value with the average value and generating a second control signal for adjusting the number of pass devices of the voltage regulator; and comparing the target value with the average value and generating a third control signal for adjusting output capacitance of the voltage regulator.

Each of the first to third control signals may be provided in a plural number.

The generating of the first control signal may include decreasing the number of activations of the plurality of first control signals when the target value is larger than the average value in the second mode; and increasing the number of activations of the plurality of first control signals when the target value is smaller than the average value in the second mode.

The generating of the second control signal may include decreasing the number of activations of the plurality of second control signals when the target value is larger than the average value in the first mode; and increasing the number of activations of the plurality of second control signals when the target value is smaller than the average value in the first mode.

The generating of the third control signal may include decreasing the number of activations of the plurality of third control signals when the target value is larger than the average value in the second mode; and increasing the number of activations of the plurality of third control signals when the target value is smaller than the average value in the second mode.

According to the voltage regulator in accordance with embodiments of the present invention, an optimization operation of the voltage regulator can be performed in realtime in the circuit by itself, so that it is possible to reduce time and cost.

Furthermore, since the voltage regulator provides digital output, digital measuring apparatuses are available instead of expensive analog measuring apparatuses, so that it is possible to easily evaluate undershoot and overshoot values very difficult to be measured.

DETAILED DESCRIPTION

Figure 1:
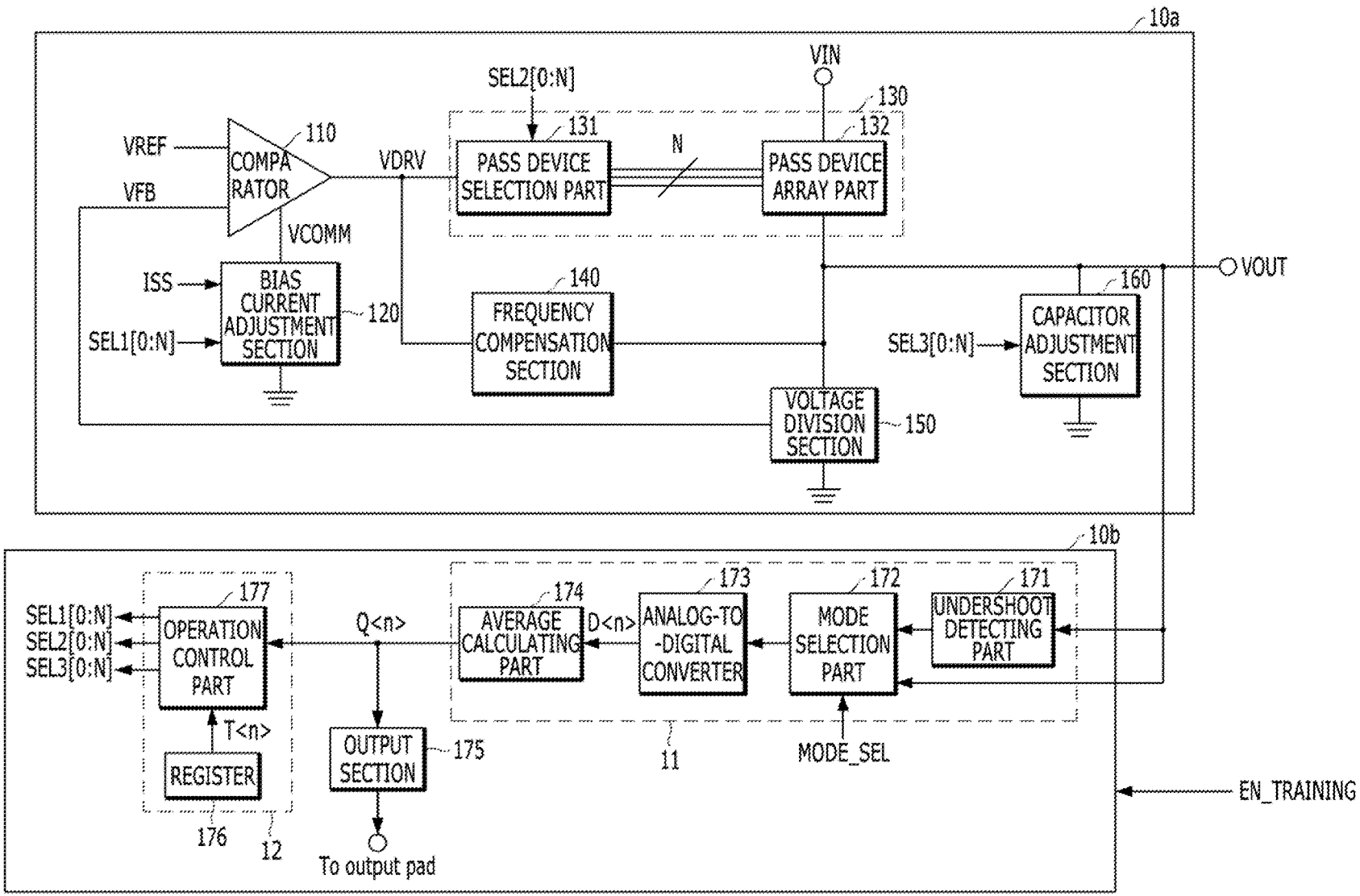
FIG. 1 is a configuration diagram illustrating a voltage regulator, according to an embodiment of the present invention.

Various embodiments will be described below in more detail with reference to the accompanying drawings. The present invention may, however, be embodied in different forms and should not be construed as being limited to the embodiments set forth herein. Rather, these embodiments are provided so that this disclosure will be thorough and complete. Throughout the disclosure, like reference numerals refer to like parts throughout the various figures and embodiments of the present invention.

Referring to FIG. 1, a voltage regulator, according to an embodiment of the present invention, may include a voltage regulation unit 10*a* and an optimization control unit 10*b*. The voltage regulation unit 10*a* may include a comparator 110, a bias current adjustment section 120, a pass device adjustment section 130, a frequency compensation section 140, a voltage division section 150, and a capacitor adjustment section 160.

The comparator 110 may compare a reference voltage VREF with a feedback voltage VFB to output a driving signal VDRV, and operate on the basis of a bias current ISS.

The bias current adjustment section 120 may adjust a current amount of the bias current ISS supplied to the comparator 110, in response to first control signals SEL1<0:N>. The first control signals SEL1<0:N> may be received from the optimization control unit 10*b* which will be described later. An operation of the bias current adjustment section 120 will be described in detail with reference to FIG. 2.

The pass device adjustment section 130 may receive the driving signal VDRV from the comparator 110, output an external power supply voltage VIN to an output terminal as an output voltage VOUT, and adjust drivability in response to second control signals SEL2<0:N>. The pass device adjustment section 130 may include a pass device selection part 131 and a pass device array part 132. The output voltage VOUT may be an internal voltage for performing an internal operation.

The pass device selection part 131 may control one or more of a plurality of pass devices to be driven in response to the second control signals SEL2<0:N>. The second control signals SEL2<0:N> may be received from the optimization control unit 10*b*.

The pass device array part 132 may drive a selected pass device in response to an output signal of the pass device selection part 131. An operation of the pass device adjustment section 130 will be described in detail with reference to FIG. 3.

The frequency compensation section 140 may ensure a phase margin for a frequency stability of a voltage regulation. The frequency compensation section 140 may, for example, include a miller capacitor (not illustrated). The frequency compensation section 140 may be disposed between the comparator 110 and the output terminal for a connection of the comparator to compensate for a frequency, thereby improving the phase margin.

The voltage division section 150 may divide the output voltage VOUT and output the divided voltage to an input terminal of the comparator 110 as the feedback voltage VFB. The voltage division section 150 may, for example, include two resistors (not illustrated) for dividing the output voltage VOUT.

The capacitor adjustment section 160 may adjust an output capacitance in response to third control signals SEL3<0:N>. The third control signals SEL3<0:N> may be received from the optimization control unit 10*b*. An operation of the capacitor adjustment section 160 will be described in more detail with reference to FIG. 4.

The optimization control unit 10*b* may evaluate a load or a transient regulation characteristic of the output voltage VOUT in response to a training enable signal EN_TRAINING, thereby optimizing a voltage regulation operation. A load regulation characteristic may indicate drivability, for example, a DC characteristic of the output voltage VOUT. A transient regulation characteristic may indicate a temporary voltage drop, for example, an AC characteristic of the output voltage VOUT.

The optimization control unit 10*b* may include an average detecting section 11 and a control signal generation section 12. The average detecting section 11 may include an undershoot detecting part 171, a mode selection part 172, an analog-to-digital converter 173, and an average calculating part 174. The control signal generation section 12 may include a register 176 and an operation control part 177. The optimization control unit 10*b* may further include an output section 175.

The undershoot detecting part 171 may detect an undershoot i.e., a temporary drop in the output voltage VOUT. For example, the undershoot detecting part 171 may detect a peak voltage having the lowest voltage level when the output voltage VOUT drops. An operation of the undershoot detecting part 171 will be described in detail with reference to FIG. 5.

The mode selection part 172 may selectively output an output voltage after having passed through the undershoot detecting part 171 or the output voltage VOUT without having passed through the undershoot detecting part 171, in response to a mode selection signal MODE_SEL. The mode selection signal MODE_SEL may be inputted from an external device. The mode selection signal MODE_SEL may be controlled by the external device to optimize the load regulation characteristic of the output voltage VOUT, such as a DC characteristic. The mode selection signal MODE_SEL may be controlled by the external device to optimize the transient regulation characteristic of the output voltage VOUT, such as an AC characteristic. Hereinafter, for simplicity, an operation mode for optimizing a load regulation characteristic of the output voltage VOUT, such as a DC characteristic, may also be referred to as a first mode, whereas an operation mode for optimizing a transient regulation characteristic of the output voltage VOUT, such as an AC characteristic, may also be referred to as a second mode.

The analog-to-digital converter 173 may convert analog code values of voltages outputted from the mode selection part 172 into digital code values D<n>.

The average calculating part 174 may calculate an average value Q<n> of the digital code values D<n> outputted from the analog-to-digital converter 173. The average calculating part 174 may, for example, calculate the average value Q<n> of the digital code values D<n> using the following Equation.

$$Q(n) = \frac{Q(n-1)^{*}(n-1) + D(n)}{n}$$

wherein 'n' indicates the number of data outputted up to now. For example, when n=5, it is possible to calculate an average value Q<5> of five pieces of data. In case of the five pieces of data is inputted, an average value Q<4> up to four pieces of data may be multiplied by 4, a current value D<5> may be added to the multiplication resultant, and then the adding resultant may be divided by 5. Accordingly, using the above Equation, it is possible to calculate an average value Q<n> of data outputted up to now.

The output section 175 may output the average value Q<n> from the average calculating part 174 to an output pad.

The register 176 may store a target value T<n> for the optimization of voltage regulation. The target value T<n> for the optimization may be selected depending on the first mode or the second mode. In the first mode, the target value T<n> for the optimization may be a value obtainable when the output voltage VOUT may not pass through the undershoot detecting part 171, such as, a value required for optimizing a DC characteristic of the output voltage VOUT. In the second mode, the target value T<n> for the optimization may be a value obtainable when the output voltage VOUT may pass through the undershoot detecting part 171, such as, a peak voltage value required for optimizing an AC characteristic of the output voltage VOUT.

The operation control part 177 may compare the average value Q<n> outputted from the average calculating part 174 with the target value T<n> stored in the register 176, and output the first to third control signals SEL1<0:N> to SEL3<0:N>. The first control signals SEL1<0:N> may control the current of the bias current adjustment section 120. The second control signals SEL2<0:N> may control the drivability of the pass device adjustment section 130. The third control signals SEL3<0:N> may control the capacitance amount of the capacitor adjustment section 160. The operation control part 177 may perform different operations according to the first mode and the second mode.

Hereinafter, an operation of the voltage regulator according to an embodiment of the present invention will be described.

In a first mode of operation, the mode selection part 172 may select the output voltage VOUT without passing through the undershoot detecting part 171 in response to the mode selection signal MODE_SEL. The analog-to-digital converter 173 may convert the output voltage VOUT outputted as an analog signal into digital code values. Then, the average calculating part 174 may calculate the average value Q<n> of the digital code values D<n> of the output voltage VOUT. The operation control part 177 may compare the target value T<n> stored in the register 176 with the average value Q<n> from the average calculating part 174 to generate the first to third control signals SEL1<0:N> to SEL3<0:N>.

When the average value Q<n> is larger than the target value T<n>, for example, when the average value of the output voltage VOUT may be higher than the target value T<n>, since it may be determined that the supply ability of the voltage regulator is sufficient, it is possible to decrease the number of pass devices to be turned on by the pass device adjustment section 130 by adjusting the values of the second control signals SEL2<0:N>. Consequently, it is possible to lower the drivability of the voltage regulator.

When the average value Q<n> is smaller than the target value T<n>, for example, when the average value of the output voltage VOUT may be lower than the target value T<n>, since it may be determined that the supply ability of the voltage regulator is not sufficient, it is possible to increase the number of pass devices to be turned on by the pass device adjustment section 130 by adjusting the values of the second control signals SEL2<0:N>. Consequently, it is possible to enhance the drivability of the voltage regulator.

In the second mode, the mode selection part 172 may select an output voltage after having passed through the undershoot detecting part 171 in response to the mode selection signal MODE_SEL. The analog-to-digital converter 173 may convert the output voltage outputted as an analog signal including a peak voltage into digital code values. Then, the average calculating part 174 may calculate the average value Q<n> of the digital code values D<n>. The operation control part 177 may compare the target value T<n> stored in the register 176 with the average value Q<n> from the average calculating part 174 to generate the first to third control signals SEL1<0:N> to SEL3<0:N>.

When the average value Q<n> is larger than the target value T<n>, for example, when a peak voltage value corresponding to an undershoot value of the output voltage VOUT may be higher than the target value T<n>, since it may be determined that a response time or a slew of the voltage regulator is sufficient, it is possible to decrease the amount of the bias current ISS flowing through the comparator 110 by adjusting the values of the first control signals SEL1<0:N> and to decrease an output capacitance by adjusting the values of the third control signals SEL3<0:N>.

However, when the average value Q<n> is smaller than the target value T<n>, for example, when the peak voltage value of the output voltage VOUT may be lower than the target value T<n>, since it may be determined that the response time or the slew of the voltage regulator is not sufficient, it is possible to increase the amount of the bias current ISS flowing through the comparator 110 by adjusting the values of the first control signals SEL1<0:N> and to increase the output capacitance by adjusting the values of the third control signals SEL3<0:N>.

As described above, the voltage regulator according to an embodiment of the present invention may perform a self-training operation, thereby detecting the DC and AC characteristics of the output voltage VOUT in the circuit by itself and thus adjusting and optimizing the bias current amount, the drivability, and the capacitance.

Figure 2:
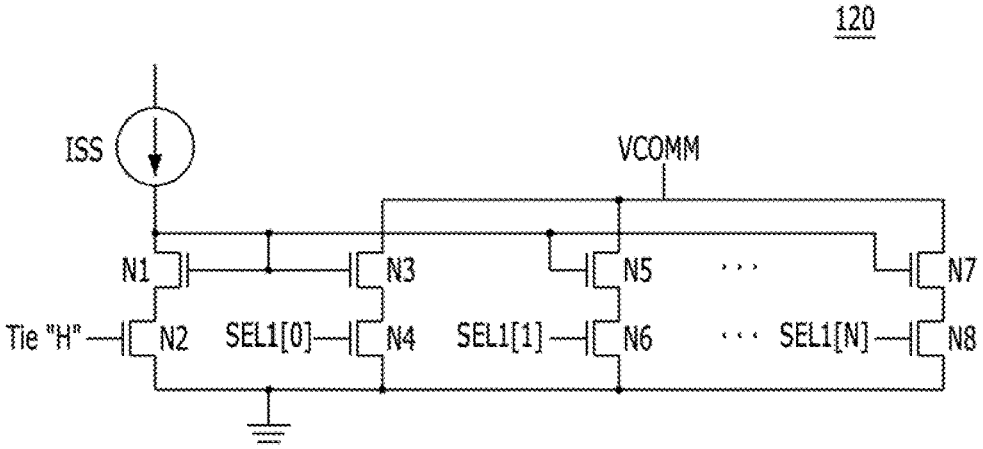
FIG. 2 is a circuit diagram illustrating an example of a bias current adjustment section of a voltage generator, according to an embodiment of the present invention.

Referring to FIGS. 1 and 2, a bias current adjustment section 120, according to an embodiment of the present invention, may include first to eighth NMOS transistors N1 to N8. A source of the first NMOS transistor N1 is coupled to a bias current source ISS and a drain of the first NMOS transistor N1 is coupled to a source of the second NMOS transistor N2. Gates of the first, third, fifth, and seventh NMOS transistors are respectively coupled to the bias current source ISS. Sources of the third, fifth, and seventh NMOS transistors N3, N5, and N7 are coupled to a coupling node VCOMM of the comparator 110. Drains of the second, fourth, sixth, and eighth NMOS transistors N2, N4, N6, and N8 are coupled to a ground voltage terminal. A source of the fourth NMOS transistor N4 is coupled to a drain of the third NMOS transistor N3. A source of the sixth NMOS transistor N6 is coupled to a drain of the fifth NMOS transistor N5. A source of the eighth NMOS transistor N8 is coupled to a drain of the seventh NMOS transistor N7. Furthermore, the second NMOS transistor N2 may receive a fixed signal Tie having a value of 'H' through its gate. The fourth, sixth, and eighth NMOS transistors N4, N6, and N8 may respectively receive the first control signals SEL1<0:N> through their gates. The first control signals SEL1<0:N> may be generated by the optimization control unit 10*b* depending on the first mode or the second mode, and may adjust the current amount of the bias current ISS flowing through the comparator 110 by driving a larger number of transistors or a smaller number of transistors.

For example, in the second mode, when the average value Q<n> outputted from the average calculating part 174 is higher or lower than the target value T<n> for the optimization, since it may be determined as to whether the response time of the voltage regulator is sufficient or not, the number of the first control signals SEL1<0:N> may be adjusted to control the activation of transistors to be driven in response to the first control signals SEL1<0:N>, so that the current amount of the bias current flowing through the comparator 110 may be decreased or increased.

Figure 3:
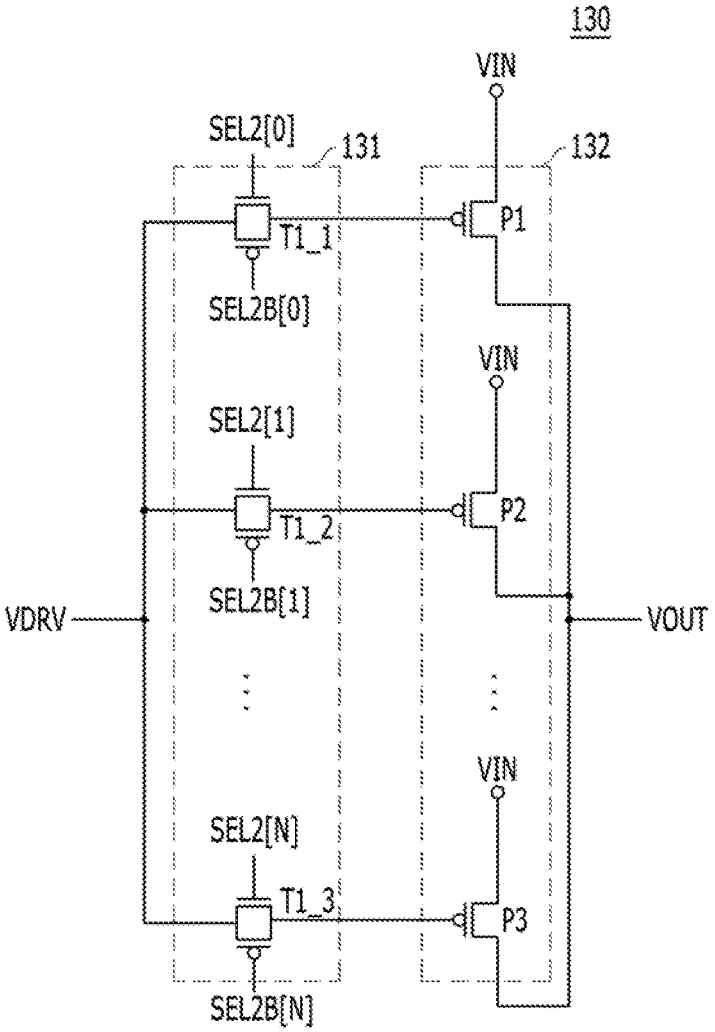
FIG. 3 is a circuit diagram illustrating an example of a pass device adjustment section of a voltage generator, according to an embodiment of the present invention.

Referring to FIGS. 1 and 3, a pass device adjustment section 130, according to an embodiment of the present invention, may include the pass device selection part 131 and the pass device array part 132.

The pass device selection part 131 may include first to third transfer elements T1_1 to T1_3. The pass device selection part 131 may transfer the driving signal VDRV from the comparator 110 to the pass device array part 132, in response to the respective second control signals SEL2<0:N>.

The pass device array part 132 may include first to third PMOS transistors P1 to P3. The first to third PMOS transistors P1 to P3 may be coupled between an external power supply voltage VIN and an output terminal. The first to third PMOC transistors P1 to P3 may output the external power supply voltage VIN as the output voltage VOUT in response to the driving signal VDRV received from the first to third transfer elements T1_1 to T1_3 through their gates.

The second control signals SEL2<0:N> may be generated by the optimization control unit 10*b* depending upon whether the first or the second mode of operation is employed, and may internally self-adjust the drivability of the voltage regulator by driving a larger or smaller number of PMOS transistors receiving the external power supply voltage VIN.

For example, in the first mode, when the average value Q<n> outputted from the average calculating part 174 is higher or lower than the target value T<n> for the optimization, since it may be determined as to whether the drivability of the voltage regulator is sufficient or not, the number of the second control signals SEL2<0:N> may be adjusted as may be needed to decrease or increase the number of PMOS transistors to be turned-on in response to the second control signals SEL2<0:N>. For example, it is possible to increase or decrease a necessary drivability by comparing a current drivability with the drivability for the optimization.

Figure 4:
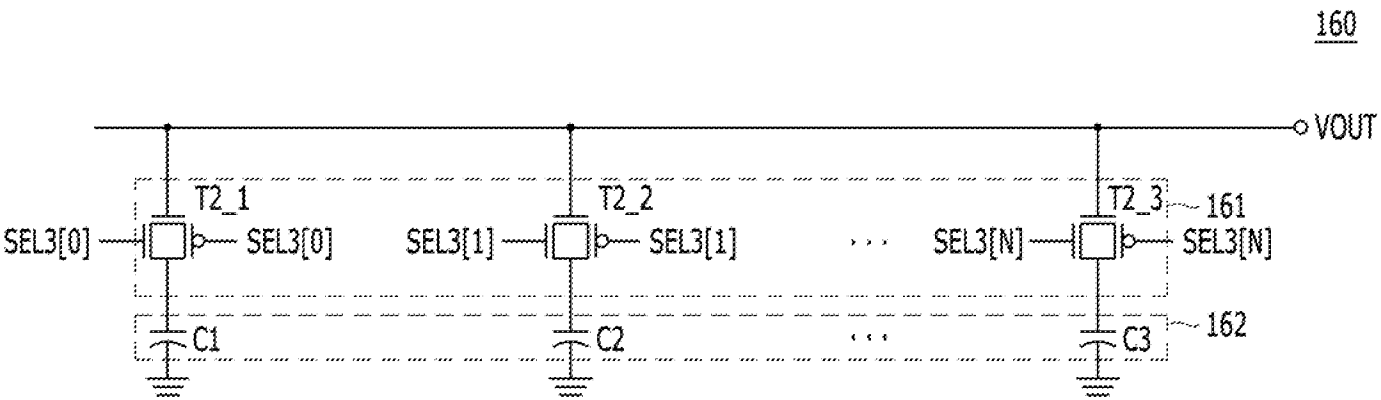
FIG. 4 is a circuit diagram illustrating an example of a capacitor adjustment section of a voltage generator, according to an embodiment of the present invention.

Referring now to FIGS. 1 and 4, a capacitor adjustment section 160, according to an embodiment of the present invention, may include a capacitor transfer control part 161 and a capacitor array part 162.

The capacitor transfer control part 161 may include first to third transfer elements T2_1 to T2_3. The capacitor transfer control part 161 may transfer the output voltage VOUT to the capacitor array part 162 in response to the respective third control signals SEL3<0:N>.

The capacitor array part 162 may include first to third capacitors C1 to C3. Each of the first to third capacitors C1 to C3 may substantially maintain the output voltage VOUT to be constant. The first to third capacitors C1 to C3 may be coupled to the output terminal of the voltage regulator depending on a transfer element activated among the first to third transfer elements T2_1 to T2_3 in response to the third control signals SEL3<0:N>, and, thus, the activated capacitor may constantly maintain the output voltage VOUT.

The third control signals SEL3<0:N> may be generated by the optimization control unit 10*b* depending on whether the first mode or the second mode is employed, and may adjust the capacitance of the output voltage VOUT by activating a larger or smaller number of capacitors coupled to the output terminal of the voltage regulator in order to substantially maintain the output voltage VOUT to be constant.

For example, in the second mode, when the average value Q<n> outputted from the average calculating part 174 is higher or lower than the target value T<n> for the optimization, since it may be determined as to whether the slew of the voltage regulator is sufficient or not, the number of the third control signals SEL3<0:N> may be adjusted to control the first to third transfer elements T2_1 to T2_3 to be activated in response to the third control signals SEL3<0:N>. Thus, it is possible to adjust the capacitance of the output voltage VOUT by decreasing or increasing the number of capacitors operating from coupling with the output terminal.

Figure 5:
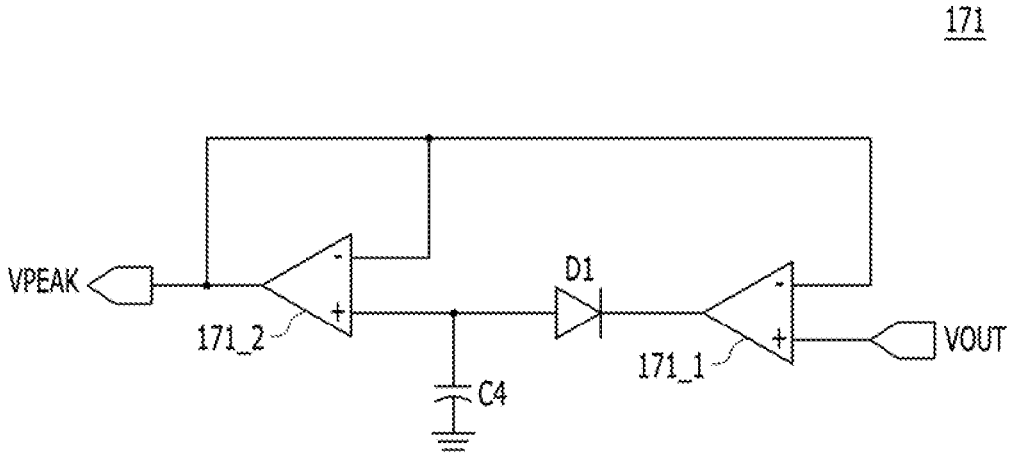
FIG. 5 is a circuit diagram illustrating an example of an undershoot detecting part of a voltage generator, according to an embodiment of the present invention.

Referring to FIGS. 1 and 5, an undershoot detecting part 171, according to an embodiment of the present invention, may include a first amplifier 171_1, a diode D1, a capacitor C4, and a second amplifier 171_2.

The first amplifier 171_1 may be an operational transconductance amplifier (OTA). The first amplifier 171_1 may receive the output voltage VOUT and a peak voltage VPEAK fed back from an output of the undershoot detecting part 171. The first amplifier 171_1 may sense the output voltage VOUT for outputting the sensed output voltage. The peak voltage VPEAK may be the lowest voltage among voltages previously outputted from the undershoot detecting part 171. When the output voltage VOUT is reduced, allowing the voltage level of an output signal of the first amplifier 171_1 to be lowered, the capacitor C4 may be discharged via the diode D1.

Then, the second amplifier 171_2 may buffer and output the lowered voltage. The lowered voltage from the second amplifier 171_2 for example, the peak voltage VPEAK may be inputted to the second amplifier 171_2 again.

In the case in which the output voltage VOUT is continuously reduced, only when a voltage value having a level lower than that of the current peak voltage VPEAK value is inputted as the output voltage VOUT, the output voltage of the first amplifier 171_1 may be lowered. Similarly to the previous operation, the capacitor C4 may be discharged via the diode.

Since the discharge operation may be performed only when the output voltage VOUT newly inputted through such an operation is lower than the peak voltage VPEAK which is the previously lowest voltage level, the peak voltage VPEAK may be the lowest voltage level of the output voltage VOUT.

However, when the voltage level of the output voltage VOUT is increased, since the diode D1 may perform a rectifying action, it is not possible to discharge or charge the capacitor C4. Accordingly, even though the voltage level of the output voltage VOUT is increased, the undershoot detecting part 171 may substantially maintain the output voltage VOUT having a low previously inputted level.

Figure 6:
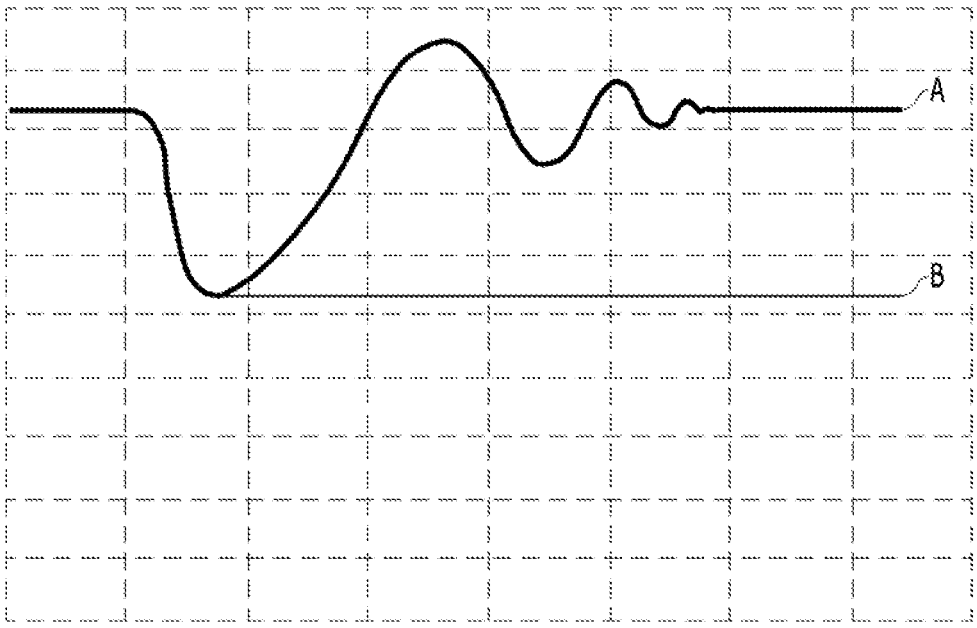
FIG. 6 is a graph illustrating an example of an output signal of a mode selection part of a voltage generator, according to an embodiment of the present invention.

Referring to FIGS. 1 and 6, a mode selection part 172, according to an embodiment of the present invention, may selectively output a signal 'A' indicating the output voltage VOUT not passing through the undershoot detecting part 171 and a signal 'B' indicating the output voltage passing through the undershoot detecting part 171 in response to the mode selection signal MODE_SEL.

The mode selection part 172 may selectively output the signal 'A' in the first mode and the signal 'B' in the second mode. The signal 'B' may be obtained by outputting the peak voltage of the output voltage VOUT obtained by the undershoot detecting part 171. For example, the signal 'B' may be kept unchanged after the lowest voltage of the signal 'A', indicating the output voltage VOUT not passing through the undershoot detecting part 171, is outputted.

Figure 7:
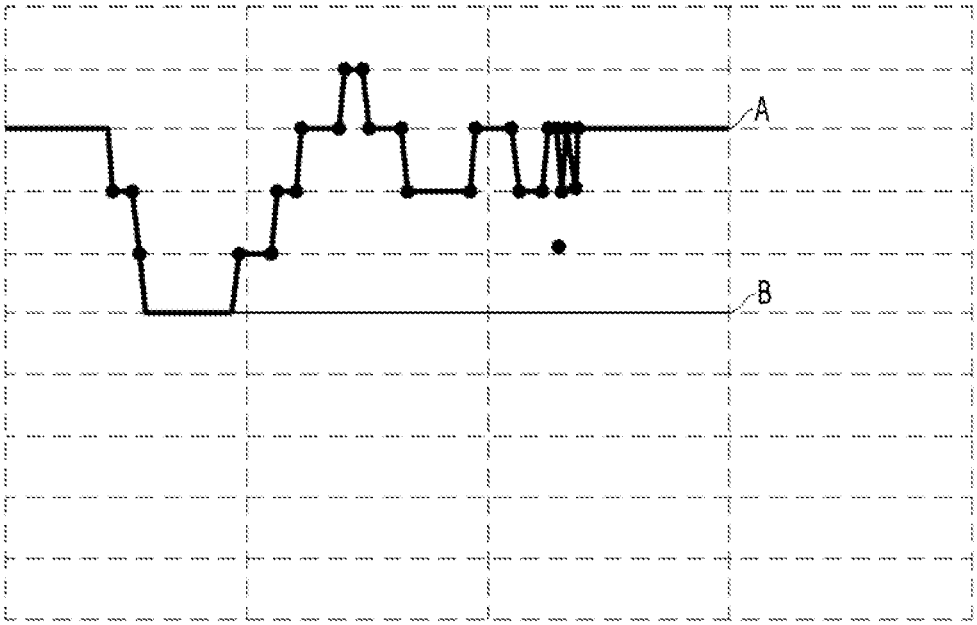
FIG. 7 is a graph illustrating an example of an output signal of an analog-to-digital converter of a voltage generator, according to an embodiment of the present invention.

Referring to FIG. 1, FIG. 7, an analog-to-digital converter 173, according to an embodiment of the present invention, may convert the analog signals 'A' or 'B' outputted from the mode selection part 172, into digital codes for outputting the digital codes. The analog-to-digital converter 173 may convert the signal 'A' into the digital codes for outputting the digital codes in the first mode. The analog-to-digital converter 173 may convert the signal 'B' into the digital codes for outputting the digital codes in the second mode.

Figure 8:
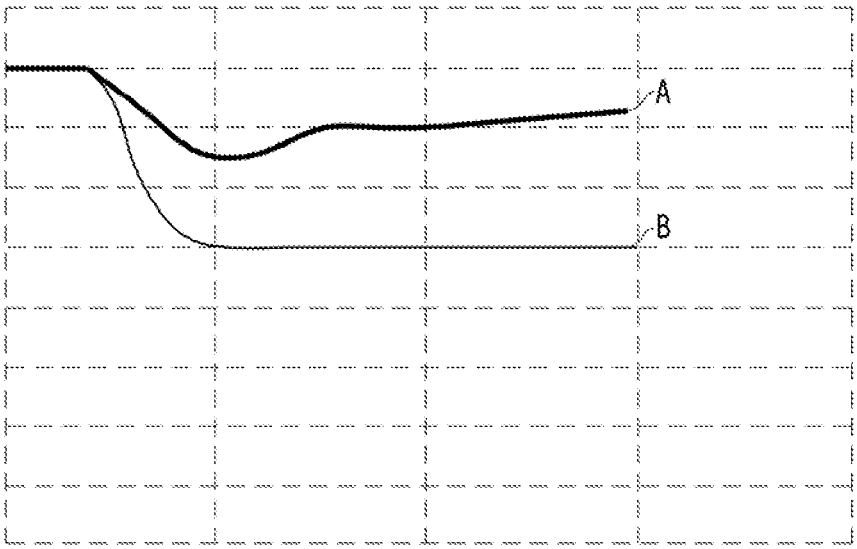
FIG. 8 is a graph illustrating an example of an output signal of an average calculating part, according to an embodiment of the present invention.

Referring to FIG. 1 and FIG. 8, an average calculating part 174, according to an embodiment of the present invention, may calculate an average value of the digital code values D<n> of the signals 'A' or 'B' indicating the output signal of the analog-to-digital converter 173 for outputting the average value. The average calculating part 174 may output the average value of the signal 'A' in the first mode. The average calculating part 174 may output the average value of the signal 'B' in the second mode.

The average calculating part 174 may calculate the average value of the signals 'A' or 'B' using the following Equation.

$$Q(n) = \frac{Q(n-1)^{*}(n-1) + D(n)}{n}$$

Wherein 'n' indicates the number of data outputted up to now. For example, when n=5, it is possible to calculate an average value Q<5> of five pieces of data. In case of the five pieces of data is inputted, an average value Q<4> up to four pieces of data may be multiplied by 4, a current value D<5> may be added to the multiplication resultant, and then the adding resultant may be divided by 5. Accordingly, using the above Equation, it is possible to calculate an average value Q<n> of data outputted up to now.

Figure 9:
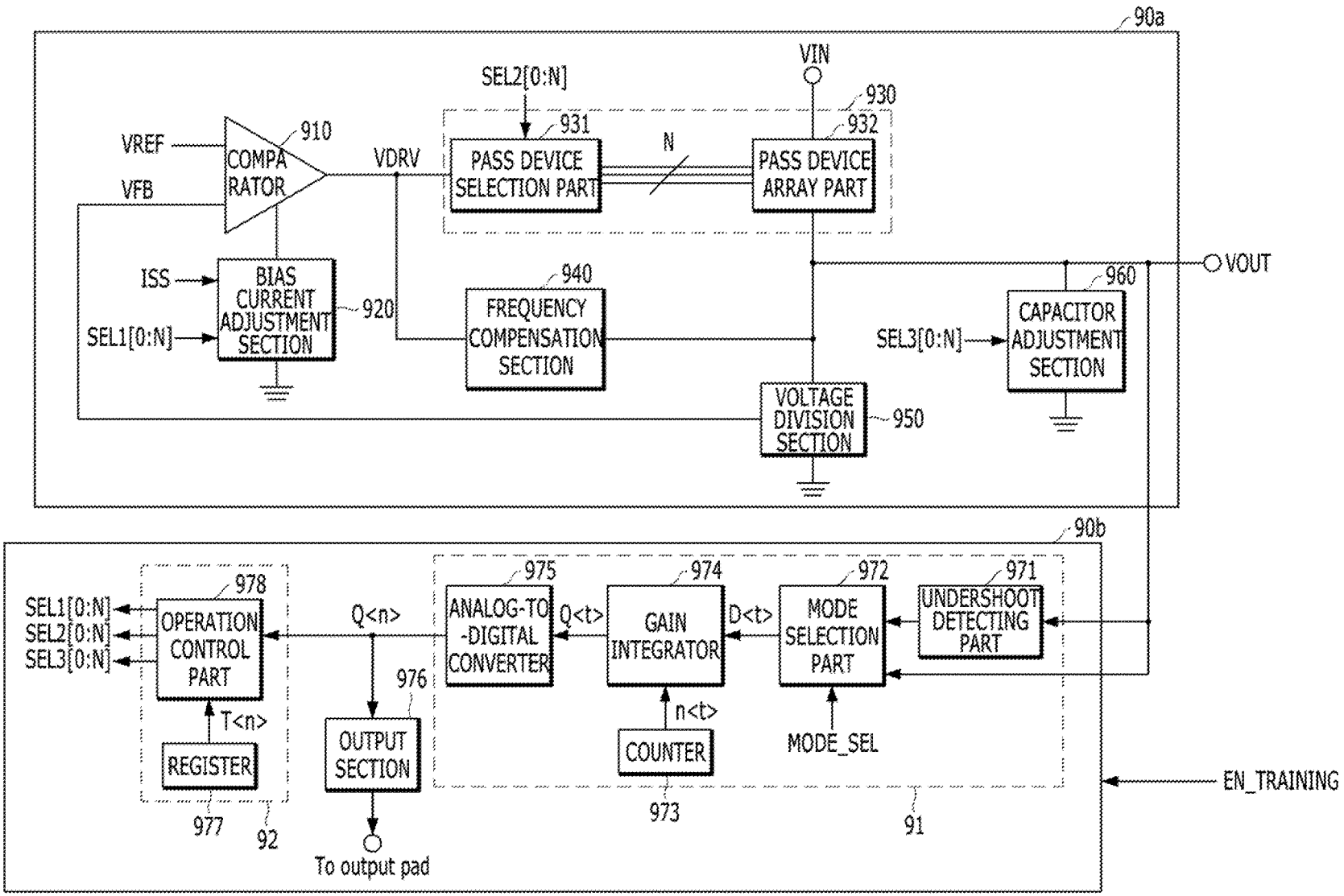
FIG. 9 is a configuration diagram illustrating a voltage regulator, according to another embodiment of the present invention.

Referring to FIG. 9, a voltage regulator, according to another embodiment of the present invention, may include a voltage regulation unit 90*a* and an optimization control unit 90*b*. The voltage regulation unit 90*a* may include a comparator 910, a bias current adjustment section 920, a pass device adjustment section 930, a frequency compensation section 940, a voltage division section 950, and a capacitor adjustment section 960.

The comparator 910 may compare a reference voltage VREF with a feedback voltage VFB for outputting a driving signal VDRV, and operate on the basis of a bias current ISS.

The bias current adjustment section 920 may adjust a current amount of the bias current ISS, which is supplied to the comparator 110, in response to first control signals SEL1<0:N>. The first control signals SEL1<0:N> may be received from the optimization control unit 90*b* which will be described later. Since a configuration and an operation of the bias current adjustment section 920 are substantially the same to those of the bias current adjustment section 120 of FIG. 1, a detailed description thereof will now be omitted.

The pass device adjustment section 930 may receive the driving signal VDRV from the comparator 910, output an external power supply voltage VIN to an output terminal as an output voltage VOUT, and adjust drivability in response to second control signals SEL2<0:N>. The pass device adjustment section 930 may include a pass device selection part 931 and a pass device array part 932.

The pass device selection part 931 may control one or more of a plurality of pass devices to be driven in response to the second control signals SEL2<0:N>. The second control signals SEL2<0:N> may be received from the optimization control unit 90*b* which will be described later.

The pass device array part 932 may drive a selected pass device in response to an output signal of the pass device selection part 931.

Furthermore, since a configuration and an operation of the pass device adjustment section 930 are substantially the same to those of the pass device adjustment section 130 of FIG. 1, a detailed description thereof will be omitted.

The frequency compensation section 940 may ensure a phase margin for a frequency stability of a voltage regulation operation. The frequency compensation section 940 may include a miller capacitor (not illustrated) between the comparator 910 and an output terminal for a connection to compensate for a frequency, thereby improving the phase margin The voltage division section 950 may divide the output voltage VOUT and output the divided voltage to an input terminal of the comparator 910 as the feedback voltage VFB. Since a configuration and an operation of the voltage division section 950 are substantially the same to those of the voltage division section 150 of FIG. 1, a detailed description thereof will be omitted.

The capacitor adjustment section 960 may adjust an capacitance of the output voltage VOUT in response to third control signals SEL3<0:N>. The third control signals SEL3<0:N> may be received from the optimization control unit 90*b* which will be described later. Since a configuration and an operation of the capacitor adjustment section 960 are substantially the same to those of the capacitor adjustment section 160 of FIG. 1, a detailed description thereof will be omitted.

The optimization control unit 90*b* may evaluate a load regulation characteristic or transient regulation characteristic of the output voltage VOUT in response to a training enable signal EN_TRAINING, thereby optimizing the voltage regulation operation. The load regulation characteristic may indicate drivability, for example, DC characteristic of the output voltage VOUT. The transient regulation characteristic may indicate a voltage drop temporarily occurring, for example, AC characteristic of the output voltage VOUT.

The optimization control unit 90*b* may include an average detecting section 91 and a control signal generation section 92. The average detecting section 91 may include an undershoot detecting part 971, a mode selection part 972, a counter 973, a gain integrator 974, and an analog-to-digital converter 975. The control signal generation section 92 may include a register 977 and an operation control part 978. The optimization control unit 90*b* may further include an output section 976.

The undershoot detecting part 971 may detect an undershoot indicating a phenomenon that the output voltage VOUT temporarily drops. For example, the undershoot detecting part 971 may detect a peak voltage having the lowest voltage level when the output voltage VOUT drops. Since a configuration and an operation of the undershoot detecting part 971 are substantially the same to those of the undershoot detecting part 171 of FIG. 1, a detailed description thereof will be omitted.

The mode selection part 972 may selectively output an output voltage passing through the undershoot detecting part 971 or the output voltage VOUT without passing through the undershoot detecting part 971, in response to a mode selection signal MODE_SEL. The mode selection signal MODE_SEL may be inputted from an external device and may be arbitrarily controlled by the external device according to whether to optimize the load regulation characteristic of the output voltage VOUT, such as, the DC characteristic, or the transient regulation characteristic of the output voltage VOUT, such as, the AC characteristic.

The gain integrator 974 may integrate an output voltage signal D<t> outputted from the mode selection part 972 on the basis of an output value of the counter 973 for outputting the integrated value. The gain integrator 974 may integrate the output voltage signal D<t>, which is an analog signal, using the following Equation.

$$Q(t) = Q(t-1)^{*}\frac{n(t)-1}{N} + D(t)^{*}\frac{1}{N}$$

The gain integrator 974 changes a gain from 1/N to N/N using the above Equation on the basis of the output value of the counter 973.

The counter 973 and the gain integrator 974 may perform operations substantially equal to those of the average calculating part 174 illustrated in FIG. 1. There is a difference in that the gain integrator 974 may calculate an average value Q<t> by integrating the output voltage signal D<t>, which is an analog signal, whereas the average calculating part 174 may calculate an average value of signals converted into digital code values.

The analog-to-digital converter 975 may convert the average value Q<t>, which is the analog signal outputted from the gain integrator 974, into a digital code value.

The output section 976 may output the digital code value from the analog-to-digital converter 975, to an output pad.

The register 977 may store a target value T<n> for the optimization of the voltage regulation operation. The target value T<n> for the optimization may be selected depending on the first mode or the second mode. In the first mode, the target value T<n> for the optimization may be a value obtainable when the output voltage VOUT does not pass through the undershoot detecting part 971, such as, a value required for optimizing the DC characteristic of the output voltage VOUT. In the second mode, the target value T<n> for the optimization may be a value obtainable when the output voltage VOUT passes through the undershoot detecting part 971, such as, a peak voltage value required for optimizing the AC characteristic of the output voltage VOUT.

The operation control part 978 may compare the signal outputted from the analog-to-digital converter 975 with the target value T<n> stored in the register 977, and output the first to third control signals SEL1<0:N> to SEL3<0:N>. The first control signals SEL1<0:N> may control the bias current ISS amount of the bias current adjustment section 920. The second control signals SEL2<0:N> may control the drivability of the pass device adjustment section 930. The third control signals SEL3<0:N> may control the capacitance amount of the output voltage of the capacitor adjustment section 960. Since a configuration and an operation of the operation control part 978 are substantially the same to those of the operation control part 177 of FIG. 1, a detailed description thereof will be omitted.

Hereinafter, an operation of the voltage regulator according to another embodiment of the present invention will be described.

In the first mode, the mode selection part 972 may select the output voltage VOUT not passing through the undershoot detecting part 971. The gain integrator may calculate an average value of the output voltage VOUT. Since the average value is an analog signal, it may be converted into a digital value by the analog-to-digital converter 975. Then, the operation control part 978 may compare the target value T<n> for the optimization stored in the register 977 with the average value of the output voltage VOUT, which has been converted into the digital value by the analog-to-digital converter 975 to generate the first to third control signals SEL1<0:N> to SEL3<0:N>.

When the average value is larger than the target value T<n>, since it may be determined that the supply ability of the voltage regulator is sufficient, it is possible to decrease the number of activations of the second control signals SEL2<0:N> for adjusting the number of pass devices of the pass device adjustment section 930. Consequently, it is possible to lower the drivability.

However, when the average value is smaller than the target value T<n>, since it may be determined that the supply ability, for example, the drivability, of the voltage regulator is not sufficient, it is possible to increase the number of activations of the second control signals SEL2<0:N>. Consequently, it is possible to enhance the drivability of the voltage regulator.

In the second mode, the mode selection part 972 may select an output voltage passing through the undershoot detecting part 971. The gain integrator 974 may calculate an average value of the output voltage including a peak voltage. Since the average value is an analog signal, it may be converted into a digital value by the analog-to-digital converter 975. Then, the operation control part 978 may compare the target value T<n> for the optimization stored in the register 977 with the average value converted into the digital value by the analog-to-digital converter 975 to generate the first to third control signals SEL1<0:N> to SEL3<0:N>.

When the average value is larger than the target value T<n>, for example, when a peak voltage value corresponding to an undershoot value of the output voltage VOUT may be higher than the target value T<n>, since it may be determined that a response time or a slew of the voltage regulator is sufficient, it is possible to decrease the amount of activations of the first control signals SEL1<0:N> for adjusting the bias current ISS amount of the bias current adjustment section 920 and the amount of activations of the third control signals SEL3<0:N> for adjusting the capacitance of the capacitor adjustment section 960. Consequently, it is possible to decrease the bias current amount and the capacitance of the output voltage VOUT.

However, when the average value is smaller than the target value T<n>, for example, when the peak voltage value of the output voltage VOUT may be lower than the target value T<n>, since it may be determined that the response time or the slew of the voltage regulator is not sufficient, it is possible to increase the amount of activations of the first control signals SEL1<0:N> and the amount of activations of the third control signals SEL3<0:N>, so that the bias current ISS amount and the capacitance of the output voltage VOUT may be increased.

As described above, the voltage regulator of FIG. 9 may perform a self-training operation, thereby detecting the DC and AC characteristics of the output voltage VOUT in the circuit by itself and thus adjusting and optimizing the bias current amount, the drivability, and the capacitance.

Figure 10:
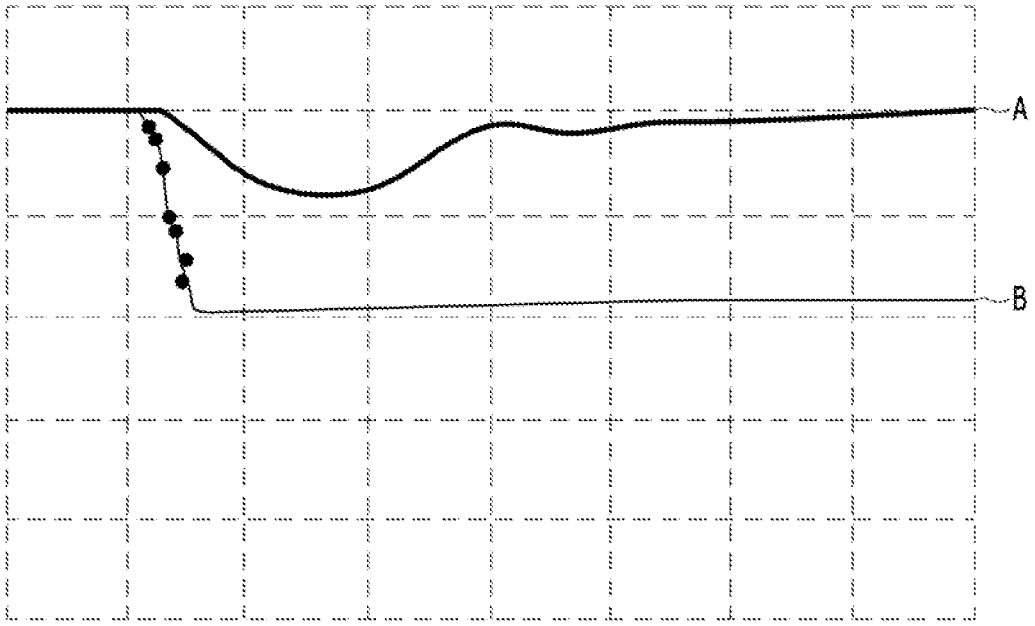
FIG. 10 is a graph illustrating an output signal of an example of a gain integrator of a voltage generator, according to another embodiment of the present invention.

FIG. 10 is a graph illustrating an output signal of a gain integrator 974, of the embodiment shown in FIG. 9. Referring to FIGS. 9 and 10, the gain integrator 974 may integrate a signal 'A' indicating the output voltage including a peak voltage inputted from the mode selection part 972 and passing through the undershoot detecting part 971, or a signal 'B' indicating the output voltage VOUT not passing through the undershoot detecting part 971, in response to the counter value n<t>. The gain integrator 974 may output an average value of each signal.

The gain integrator 974 may integrate the signals 'A' or 'B' using the following equation.

$$Q(t) = Q(t-1)^* \frac{n(t)-1}{N} + D(t)^* \frac{1}{N}$$

The gain integrator 974 may change a gain from 1/N to N/N using the above equation on the basis of the output value n<t> of the counter 973, and calculate the average value Q<t> of data outputted up to now.

Figure 11:
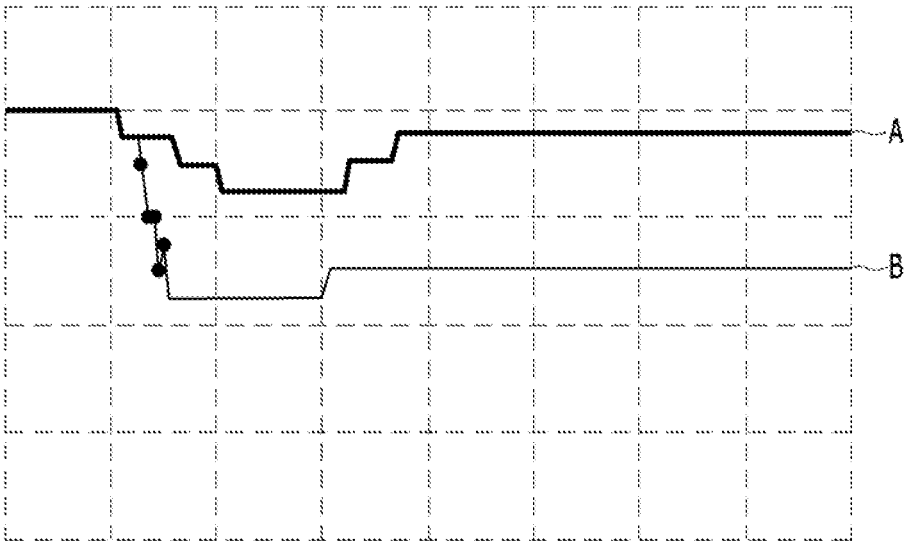
FIG. 11 is a graph illustrating an output signal of an example of an analog-to-digital converter of a voltage generator, according to another embodiment of the present invention.

FIG. 11 is a graph illustrating an output signal of an analog-to-digital converter 975 of FIG. 9.

Referring to FIGS. 9 and 11, the analog-to-digital converter 975 may convert the analog signals 'A' or 'B', which are integrated by and outputted from the gain integrator 974, into digital codes. The ADC converter 975 may convert the signal 'A' into digital codes for outputting the digital codes in the first mode. The ADC converter 975 may convert the signal 'B' into the digital codes for outputting the digital codes in the second mode.

Although various embodiments have been described for illustrative purposes, it will be apparent to those skilled in the art to which this invention pertains after having read the present disclosure that various changes and modifications may be made without departing from the spirit and scope of the invention as defined in the following claims.

What is claimed is:

1. A voltage regulator comprising:

a voltage regulation unit configured to regulate an external power supply voltage and for outputting a constant internal voltage; and an optimization control unit configured to adjust a bias current, a drivability, and an output capacitance of the voltage regulation unit in response to a training enable signal and for optimizing the internal voltage to a predetermined value, wherein the optimization control unit comprises:

an average detecting section configured to detect an average value of the internal voltage corresponding to a first or second mode in response to the training enable signal; and a control signal generation section configured to compare the average value of the internal voltage with a target value for generating a first to a third control signal.

2. The voltage regulator of claim 1, wherein the voltage regulation unit comprises:

a comparator configured to compare a reference voltage with a feedback voltage for outputting a driving signal and for operating using the bias current;

a bias current adjustment section configured to adjust the bias current supplied to the comparator in response to the first control signal;

a pass device adjustment section configured to output the external power supply voltage to an output terminal as the internal voltage according to the driving signal, and for adjusting the drivability in response to the second control signal;

a capacitor adjustment section configured to adjust the output capacitance in response to the third control signal; and a voltage division section configured to divide the output voltage and for outputting a divided voltage to an input terminal of the comparator as the feedback voltage.

3. The voltage regulator of claim 2, wherein each of the first to the third control signal includes a plurality of corresponding control signals.

4. The voltage regulator of claim 3, wherein the pass device adjustment section comprises:

a pass device selection part configured to select one or more of a plurality of pass devices in response to the plurality of control signals of the second control signal; and a pass device array part including the plurality of pass devices and configured to drive the external power supply voltage in response to the driving signal.

5. The voltage regulator of claim 4, wherein the pass device selection part comprises:

a plurality of transfer elements configured to transfer the driving signal to the pass device array part in response to the plurality of control signals of the second control signal.

6. The voltage regulator of claim 3, wherein the capacitor adjustment section comprises:

a capacitor transfer control part configured to select one or more of a plurality of capacitors in response to the plurality of control signals of the third control signal; and a capacitor array part including the plurality of capacitors and configured to maintain the internal voltage to be constant.

7. The voltage regulator of claim 6, wherein the capacitor transfer control part comprises:

a plurality of transfer elements configured to transfer the internal voltage to the capacitor array part.

8. The voltage regulator of claim 1, wherein the average detecting section comprises:

an undershoot detecting part configured to detect an undershoot peak voltage of the internal voltage;

a mode selection part configured to selectively output an output signal of the undershoot detecting part or the internal voltage in response to a mode selection signal;

an analog-to-digital converter configured to convert an output signal of the mode selection part into digital code values; and an average calculating part configured to output an average value of the digital code values outputted from the analog-to-digital converter.

9. The voltage regulator of claim 8, wherein the mode selection part selects the internal voltage in the first mode and selects the output signal of the undershoot detecting part in the second mode.

10. The voltage regulator of claim 1, wherein the control signal generation section comprises:

a register configured to store the target value; and an operation control part configured to compare the target value with the average value and for controlling each of the first to the third control signal.

11. The voltage regulator of claim 1, further comprising:

a frequency compensation section configured to ensure a phase margin of the internal voltage.

12. The voltage regulator of claim 1, wherein the average detecting section comprises:

an undershoot detecting part configured to detect an undershoot peak voltage of the internal voltage;

a mode selection part configured to selectively output an output signal of the undershoot detecting part or the internal voltage in response to a mode selection signal;

a gain integrator configured to integrate and outputting an output signal of the mode selection part; and an analog-to-digital converter configured to convert an output signal of the gain integrator into a digital code value.

13. The voltage regulator of claim 12, wherein the mode selection part selects the internal voltage in the first mode and selects the output signal of the undershoot detecting part in the second mode.

14. An operating method of a voltage regulator, comprising:

generating a control signal for optimizing voltage regulating operation of the voltage regulator; and performing the voltage regulating operation in response to the control signal and a driving signal that is generated by comparing a reference voltage with a feedback voltage fed back from an output voltage of the voltage regulator, wherein the generating the control signal for optimizing the voltage regulating operation, comprises:

detecting an undershoot of an output voltage of the voltage regulator;

selecting the detected undershoot of the output voltage in a second mode in response to a mode selection signal;

converting the output voltage or the undershoot of the output voltage into digital codes;

calculating an average value of the digital codes; and comparing the average value with a target value stored in a register and generating the control signal for controlling the voltage regulator, wherein the feedback voltage is generated by dividing the output voltage.

15. The operating method of the voltage regulator of claim 14, wherein the generating of the control signal for optimizing voltage regulating operation of the voltage regulator, wherein the control signal includes a first to a third control signal, comprises:

selecting the output voltage of the voltage regulator in a first mode in response to the mode selection signal;

comparing the target value with the average value and generating the first control signal for adjusting a current amount of a bias current of the voltage regulator;

comparing the target value with the average value and generating the second control signal for adjusting the number of pass devices of the voltage regulator; and comparing the target value with the average value and generating the third control signal for adjusting output capacitance of the voltage regulator.

16. The operating method of the voltage regulator of claim 15, wherein each of the first to the third control signal includes a plurality of corresponding control signals.

17. The operating method of the voltage regulator of claim 16, wherein the generating of the first control signal comprises:

decreasing the number of activations of the plurality of control signals of the first control signal when the target value is larger than the average value in the second mode; and increasing the number of activations of the plurality of control signals of the first control signal when the target value is smaller than the average value in the second mode.

18. The operating method of the voltage regulator of claim 16, wherein the generating of the second control signal comprises:

decreasing the number of activations of the plurality of control signals of the second control signal when the target value is larger than the average value in the first mode; and increasing the number of activations of the plurality of control signals of the second control signal when the target value is smaller than the average value in the first mode.

19. The operating method of the voltage regulator of claim 16, wherein the generating of the third control signal comprises:

decreasing the number of activations of the plurality of control signals of the third control signal when the target value is larger than the average value in the second mode; and increasing the number of activations of the plurality of control signals of the third control signal when the target value is smaller than the average value in the second mode.

20. The operating method of the voltage regulator of claim 14, wherein the target value is a value required for optimizing a load regulation characteristic of the output voltage and a value required for optimizing a transient regulation characteristic of the output voltage.

21. The operating method of the voltage regulator of claim 14, wherein the voltage regulating operation is performed by adjusting drivability of the voltage regulator in the first mode and by adjusting a bias current or capacitance of the voltage regulator in the second mode in response to the control signal.

22. An operating method of a voltage regulator, comprising:

detecting an undershoot of an output voltage of the voltage regulator;

selecting the output voltage of the voltage regulator in a first mode and selecting the undershoot in a second mode in response to a mode selection signal;

converting the output voltage or the undershoot into digital codes;

calculating an average value of the digital codes;

comparing the average value with a target value stored in a register and generating a control signal for controlling the voltage regulator; and performing a voltage regulating operation in response to the control signal, wherein the generating of the control signal comprises:

comparing the target value with the average value and generating a first control signal for adjusting a current amount of a bias current of the voltage regulator;

comparing the target value with the average value and generating a second control signal for adjusting the number of pass devices of the voltage regulator; and comparing the target value with the average value and generating a third control signal for adjusting output capacitance of the voltage regulator.

* * * * *